US005518140A

United States Patent [19]

Lenz et al.

[11] Patent Number: 5,518,140

[45] Date of Patent: May 21, 1996

[54] LIQUIFIED GAS STORAGE TANK OVERFILL PROTECTION SYSTEM AND METHOD

[75] Inventors: Robert D. Lenz, Littleton; Richard J. Jaeger, Denver; Glen E. McIntosh, Boulder, all of Colo.

[73] Assignee: Cryenco, Inc., Denver, Colo.

[21] Appl. No.: 335,115

[22] Filed: Nov. 7, 1994

[51] Int. Cl.[6] ..... F17C 1/00

[52] U.S. Cl. ..... 220/584; 220/585; 220/586; 220/469; 220/528

[58] Field of Search ..... 220/584, 585, 220/586, 469, 528, 553

[56] References Cited

U.S. PATENT DOCUMENTS

| | | | |
|---|---|---|---|
| 339,885 | 4/1886 | Hill | 220/585 |
| 2,417,873 | 3/1947 | Huber | 220/586 |
| 3,064,344 | 11/1962 | Arne | 220/586 |
| 3,338,238 | 8/1967 | Warncke | 220/585 |
| 4,982,870 | 1/1991 | Van Loon | 220/586 |

*Primary Examiner*—Joseph M. Moy

*Attorney, Agent, or Firm*—Holland & Hart; Lee R. Osman

[57] ABSTRACT

A liquified gas tank overfill protection system for use in a tank having a hermetically sealed chamber. The overfill protection system includes a shroud mounted in the chamber in a spaced relationship to the interior side of the chamber. The shroud divides the chamber into a plurality of spatially normally communicating portions. Preferably, the shroud has a generally elongated concave downward shape.

13 Claims, 5 Drawing Sheets

LIQUIFIED GAS STORAGE TANK OVERFILL PROTECTION SYSTEM AND METHOD

BACKGROUND OF THE INVENTION

1. Field of the Invention

This invention relates to liquified gas storage tanks, and more particularly to a new and improved overfill protection system mounted inside the storage tank.

2. Description of the Prior Art

In recent times, liquified gases have become popular for use as a fuel in many industrial and commercial applications. Liquified gases are extremely cold and as such thermal storage tanks have been developed to permit safe and economical use of liquified gases as fuels. These tanks are generally known as dewar tanks.

One of the important and relatively new uses of liquified gas includes use as fuel for powering internal combustion engines in both commercial and private vehicles. Typically, liquid natural gas, LNG, is the preferred gas for this purpose. The development of LNG as a fuel has been concentrated in the area of commercial vehicles, such as tractor trailers, delivery trucks, and mass transit vehicles.

One of the major problems encountered in using LNG as a fuel is the refilling of the fuel tanks after they have been depleted. There are several concerns associated with refilling LNG storage tanks on commercial vehicles. Some of these include filling the tanks to the appropriate level to allow a sufficient holding time between when the tank is filled and the pressure in the tank reaches the relief pressure, minimizing the manpower necessary to fill the tanks, and minimization or elimination of the venting of the LNG to the atmosphere during the filling process.

The holding time of a tank is the difference in time between when the tank is filled and when the tank reaches the set pressure of the relief valves. The holding time is important because an LNG tank is not always used immediately after being filled, and must be able to sit for a given time until it is needed. Typically, the full tank is not interfaced with temperature and pressure control apparatus during the holding time. Therefore, the contents of the tank are subject to the external ambient conditions during the holding time. To allow for a given holding time, there must be a certain amount of gaseous volume in the tank, depending on the physical conditions inside and outside the tank, to allow the pressure inside the tank to rise without reaching the predetermined relief pressure. In addition, it is desirable to assure that only gas will vent if the relief valves open.

An accurate and reliable system for use in determining when an LNG tank has been filled to the appropriate level is an important component in addressing the problems of hold time and venting. When filling a tank with LNG, a balance must be struck between filling the tank to a liquid level such that there is an appropriate amount of vapor space to be pressurized as the tank absorbs heat from the environment, and the need to provide a sufficient amount of vapor space to allow the tank to have a sufficient holding time.

Also of concern is the need to have a tank that can be filled sufficiently full so as to not waste valuable space and weight on the vehicle. The vapor space must be adequate to allow the tank to absorb energy from its surroundings without reaching the relief pressure before the predetermined hold time has expired. Typically these tanks have a minimum holding time of between seven and eight days, and a fill pressure between 20 and 80 psi, with a relief pressure of approximately 250 psi.

If the tank is overfilled, there is not enough vapor space left in the tank to allow the tank pressure to increase without venting due to heat absorption from the surroundings. This situation would cause the pressure inside the tank to reach the relief pressure before the predetermined hold time has expired, thus causing LNG to vent into the atmosphere through a the relief valve.

Venting LNG to the atmosphere has known adverse environmental impacts, and is a highly regulated activity. Venting natural gas to the atmosphere carries with it considerable risk both to the environment and to the safety of the tank surroundings. On the other hand, if the tank is underfilled, the operator is then not able to obtain the maximum benefit of a full tank. The same safety and environmental concerns do not accompany underfilling an LNG tank.

Accurate, repeatable, and convenient apparatus that meets the above requirements are also of great importance economically. A fill procedure that is nearly automatic and requires a minimum amount of labor is desirable from an economic standpoint. An overfill protection apparatus that allows for accurate and repeatable results would make the use of LNG more economically feasible, creating a favorable incentive to the LNG industry to further develop LNG as a fuel.

Several prior art fill systems have been developed for use with LNG. One of the most basic is the use of differential pressure to measure the volume level of liquid in a tank in order to determine when the tank is sufficiently full. Differential pressure measurement is typically used in large stationary cryogenic tanks. Differential pressure measurement is accomplished with one gage that is capable of measuring the differential pressure across a diaphragm. This system works fairly well for large stationary tanks.

However, LNG is very light, and it has been found uneconomical to develop a sensor system that is sufficiently accurate to measure the slight changes in pressure in a tank of the size used on a commercial vehicle, and also make that measurement apparatus strong enough to withstand the impact, jarring and general abuse it would encounter when being used on a commercial vehicle. These sensors are very delicate and have been found to be inaccurate and even fail during use in the vibrating and abusive world of an over-the-road vehicle.

Another apparatus used to measure the level of LNG during the filling of a tank is a full tri-cock. The full tri-cock is simply a dip tube that spurts liquid when the liquid natural gas reaches the end of the tube inside the tank. This apparatus obviously is not adequate to control the venting of liquid natural gas to the atmosphere. It is also labor intensive.

Other devices used to measure the level of LNG in a tank during filling include point sensors, which are simply sensors located along a vertical rake at discreet points in the tank. As the sensors come into contact with the LNG, the sensors send a signal to a receiver indicating such. This apparatus requires monitoring during fill-up, and also is fairly expensive and susceptible to damage during use.

The problems of venting LNG to the atmosphere during the fill procedure, striking the balance between filling the tank too full and not filling it adequately, and providing a repeatable and accurate fill level have not been successfully resolved in the art. It is to overcome these shortcomings in the prior art that the present invention was developed.

SUMMARY OF THE INVENTION

The present invention in general terms concerns an overfill protection system for use in properly filling liquified gas tanks so as to obtain a proper gas volume in the tank after filling, and also to vent only gaseous natural gas if the relief pressure is reached.

The overfill protection system provides functionality that overcomes the aforementioned problems. The system insures a proper amount of gas volume in a filled tank without internal tank monitoring because of its structural design, acting to isolate separate portions of the space inside the tank during the fill process.

The liquified gas tank overfill protection system of the present invention is for use in a tank having a wall defining a hermetically sealed chamber, the wall having an interior side and a portal for introducing a liquified gas into the chamber to accumulate in said tank. The tank has gas vapor inside the chamber during filling. The introduction of the liquified gas results in a rising liquid level within the chamber. The overfill protection system includes a shroud mounted in the chamber in a spaced relationship to the interior side. The shroud divides the chamber into a plurality of spatially normally communicating portions, the gas vapor in the portions being isolated by the liquid in the chamber upon the liquid level reaching a predetermined level.

Preferably, the shroud has a generally elongated concave downward shape with opposite ends and downwardly depending legs that define longitudinal edges extending the length of the shroud. The shroud is hermetically sealed to the interior side along the opposite ends, with the edges of the shroud being spaced from the interior side, dividing the chamber into two portions normally communicating along the edges.

Accordingly, it is a primary object of the present invention to provide a new and improved system for preventing the overfill of liquified gas tanks.

It is another object of the present invention to provide an overfill system that insures a predetermined gas volume in a liquified gas tank after filling.

Still another object of the present invention is to eliminate the need for internal monitoring of the tank during the filling process.

A further object of the present invention is to insure that only gas vapor is vented to the atmosphere if the relief pressure is reached.

DESCRIPTION OF THE PREFERRED EMBODIMENT

Figure 1:
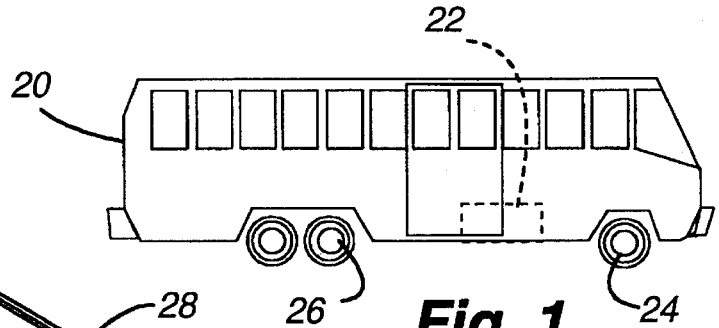
FIG. 1 is an elevation view of a vehicle incorporating a tank with the fill system of the present invention.

Referring to FIG. 1, a commercial vehicle 20, particularly a bus, having a fuel tank 22 incorporating the present invention is shown. The fuel tank is located between front 24 and rear 26 axles, as shown by the hidden lines. The tank is fixed to the vehicle in any conventional manner, and as with conventional fuel tanks it remains on the vehicle when the tank is being filled.

Figure 2:
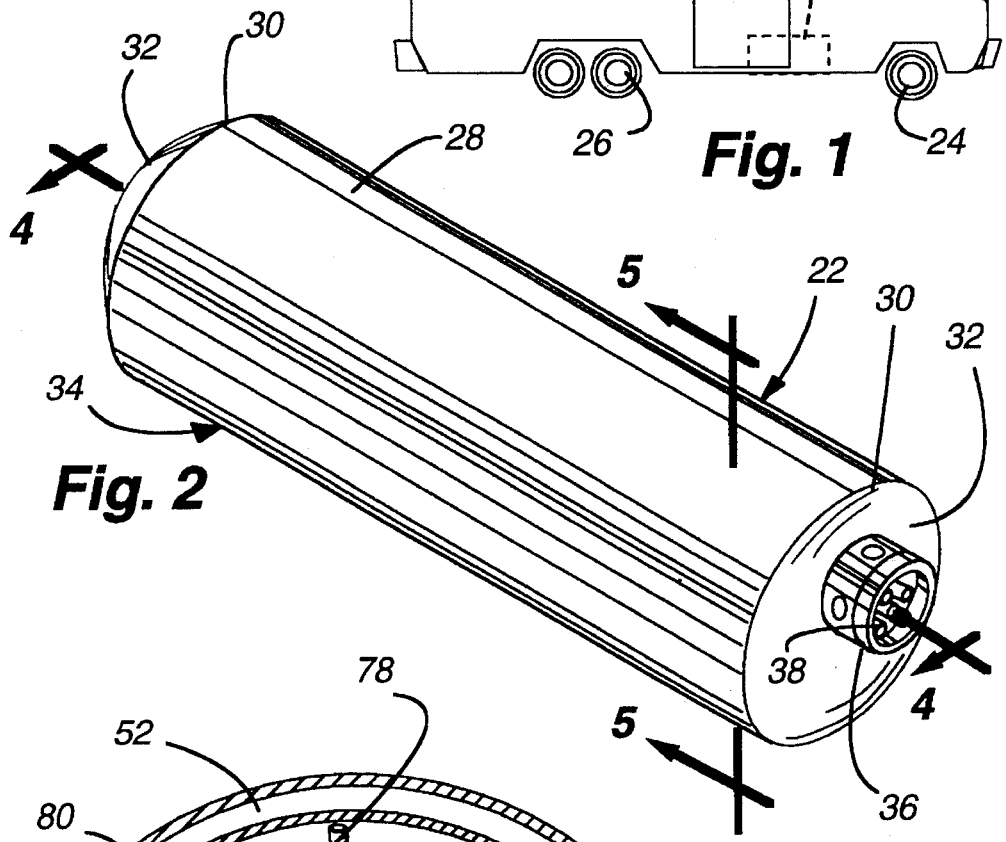
FIG. 2 is an isometric view of the tank shown in the vehicle in FIG. 1.

Referring now to FIG. 2, the fuel tank 22 is shown as being of typical double wall vacuum jacketed dewar style tank construction, comprising a cylindrical external tank wall 28 and opposing ends 30. Partial spherically shaped convex cap end walls 32 are hermetically attached at either end 30 to form an airtight and liquid tight outer container 34.

At one end 30 of the tank 22, extending from a cap end wall 32, is a utility portal 36 which facilitates access to the interior of the tank from one central location. The tank is filled through one of a plurality of tubes 38 extending through the utility portal. All other functions requiring access to the interior of the tank utilize the appropriate interface tube located in the utility portal. The tank is mounted on the vehicle 20 with its longitudinal axis oriented horizontally.

Figure 3:
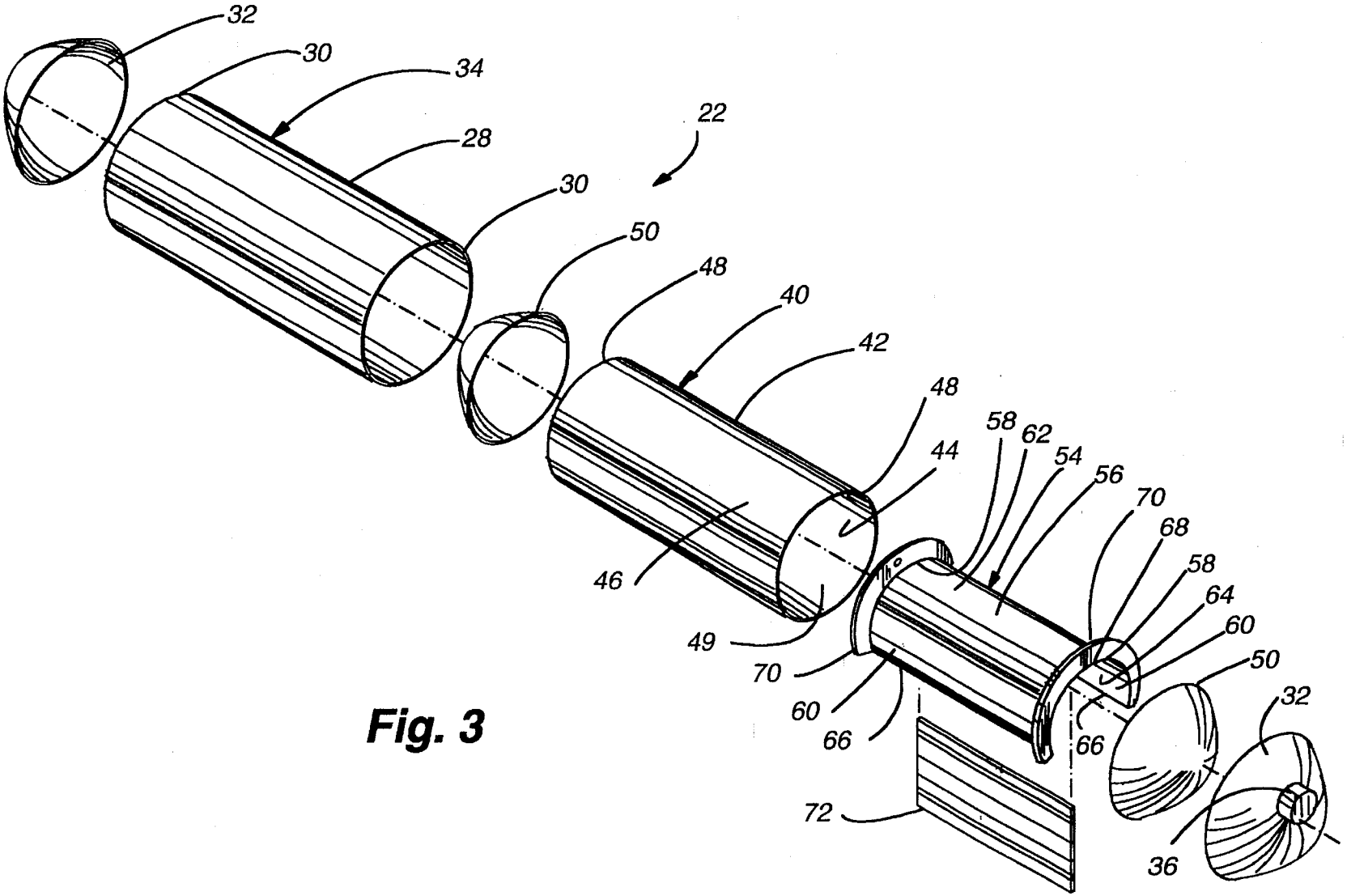
FIG. 3 is an exploded isometric view of the tank shown in FIG. 2.

Referring now to FIG. 3, an exploded view of the general tank structure including the present invention is shown. The outer container 34 can be seen to coaxially surround an inner container 40, or tank, having an elongated cylindrically shaped body 42 with an interior side 44, an exterior side 46, and opposing ends 48. Partial spherically shaped convex cap end walls 50 are hermetically attached to either end 48, defining an enclosed chamber 49.

The inner container structure is similar to the structure of the outer container, except it is smaller in dimension. The inner container is retained in a conventional manner inside the outer container in spaced relationship therewith, to form a dewar type tank. The tubes 38 protruding through the utility portal extend inwardly into the inner container through the adjacent cap end wall 50 of the inner container. A space 52 (see FIG. 4) defined between the inner and outer containers is drawn to a vacuum to provide for thermal insulation of the inner container from the ambient environment. Oftentimes a radiation barrier material (not shown) is placed in the space to provide for insulation from radiation heat transfer.

A shroud 54 is coaxially positioned within the inner container and comprises a substantially semi-cylindrical main body 56 with opposing ends 58, and two downwardly laterally opposing legs 60. The main body 56 defines an upwardly directed convex upper face 62 and a downwardly directed concave lower face 64. The downwardly laterally opposing legs each terminate at a predetermined length and form opposing longitudinal edges 66 extending along the length of the main body 56 of the shroud 54. Each of the opposing ends 58 define a peripheral edge 68. Radial flanges 70 are hermetically attached along the peripheral edges 68 at each of the opposing ends 58 of the main body for a purpose to be described later.

The shroud 54 is placed within the inner container 40 and the flanges 70 are hermetically fixed as by welding along their outer edge to the interior side 44 of the inner container 40. Preferably, the shroud is oriented within the inner container so as to be symmetrical about a central vertical plane extending through the tank 20 when the tank is horizontally oriented.

A baffle heat exchanger 72 is fixed, as by mechanical attachment, in a vertical orientation between the lower face 64 of the shroud 54 and the interior side 44 of the inner container 40. The baffle heat exchanger is described in U.S. patent application Ser. No. 08/016,621, filed Feb. 12, 1993, assigned to the assignee of the present invention, and is hereby incorporated by reference.

Figure 4:
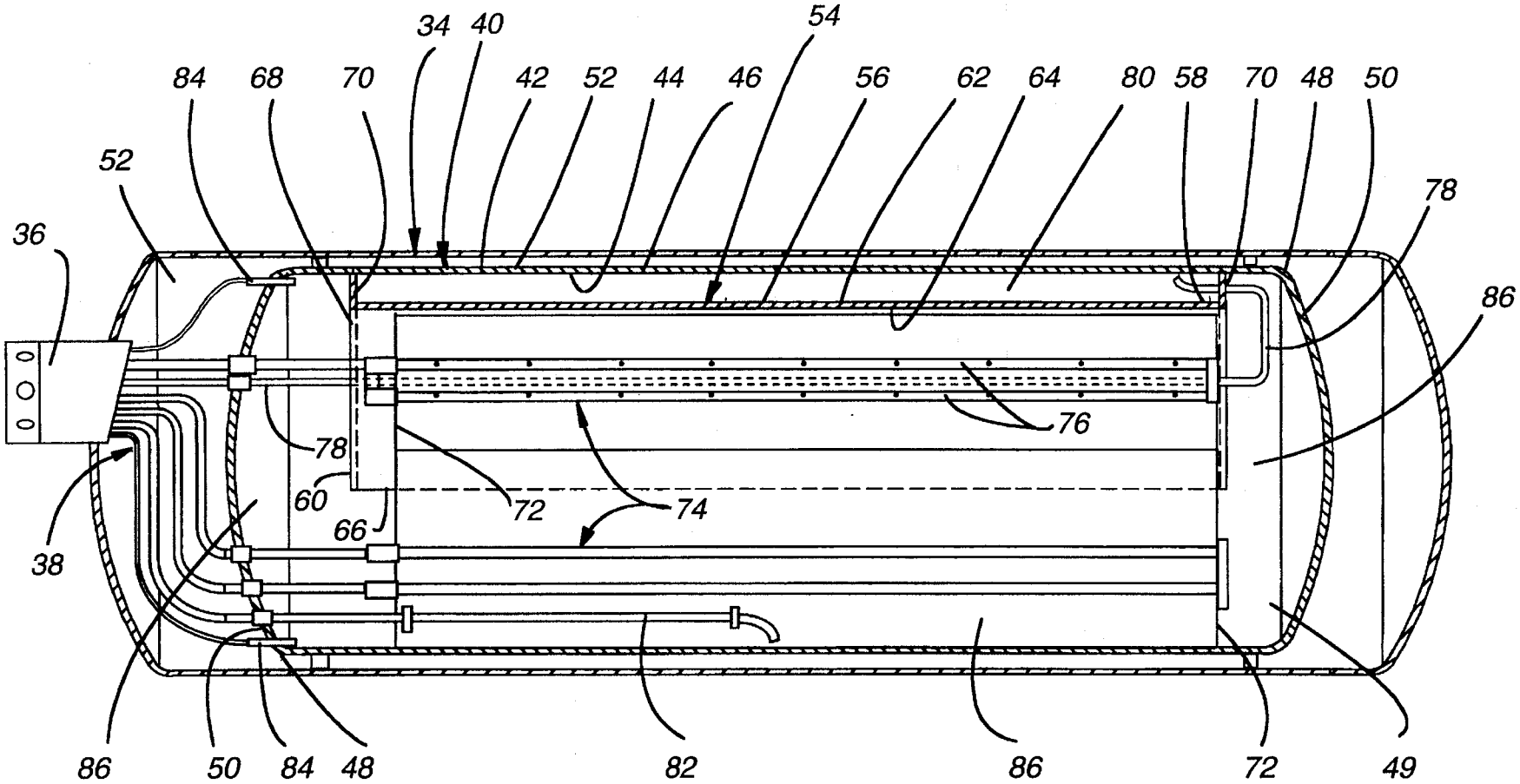
FIG. 4 is an enlarged section taken substantially along line 4—4 of FIG. 2.
Figure 6:
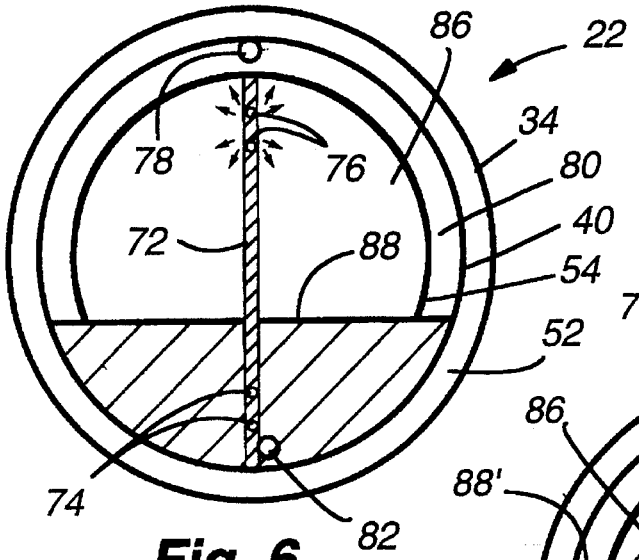
FIG. 6 is a schematic transverse section of the interior of the tank incorporating the present invention illustrating an early liquid level in a fill process.

Referring now to FIG. 4, the interior structure of the fuel tank 22 is shown. The baffle heat exchanger 72 physically divides the enclosed space 49 of the inner container 40 below the shroud 54 into two substantially equal spaces. The baffle heat exchanger is preferably of the same length as the shroud. The inner container 40 extends beyond both ends of the shroud and heat exchanger to allow for free movement of fluid between the two sides of the heat exchanger to avoid any temperature stratification in the liquified gas. The baffle heat exchanger is rectangular in shape and is preferably made of metal having good heat transfer properties. A suitable material would be aluminum.

Attached to the baffle 72 are a plurality of vertically spaced tubes 74 which run along the length of the baffle heat exchanger for various utilitarian purposes. In the preferred embodiment, two of these tubes are perforated fill tubes 76 to allow for the entry of LNG into the tank. The perforated tubes 76 cause the LNG to spray into the chamber 49 of inner container 40 and collect in the bottom of the container, as discussed in more detail below. Various heat exchanger tubes 74 run along the length of the heat exchanger baffle in other locations as described in the above-mentioned patent application Ser. No. 08/016,621. A vent, relief and vapor withdrawal tube 78 runs along the length of the baffle heat exchanger 72 and extends through the flange 70 of the shroud 54 into a peripheral space 80 defined between the shroud 54 and the interior side 44 of the inner container 40. This allows both for the withdrawal of gas from the peripheral space 80 when feeding fuel to the vehicle 20, and venting gaseous natural gas when the internal pressure in the tank 22 reaches the relief pressure.

A liquid withdrawal tube 82 allows for the extraction of LNG from the tank, and is thus located near the bottom of the tank 22. Pressure sensor gauges 84 are mounted in and extend through the inner container cap end wall 50 adjacent to the top and bottom of the inner container to allow for pressure measurement readings. As is typical with most tanks built to hold liquified gases, all of the tubes 74 exit through the utility portal to minimize the adverse effect on both the insulating properties of the structure and the structural integrity of the tank 22.

Figure 5:
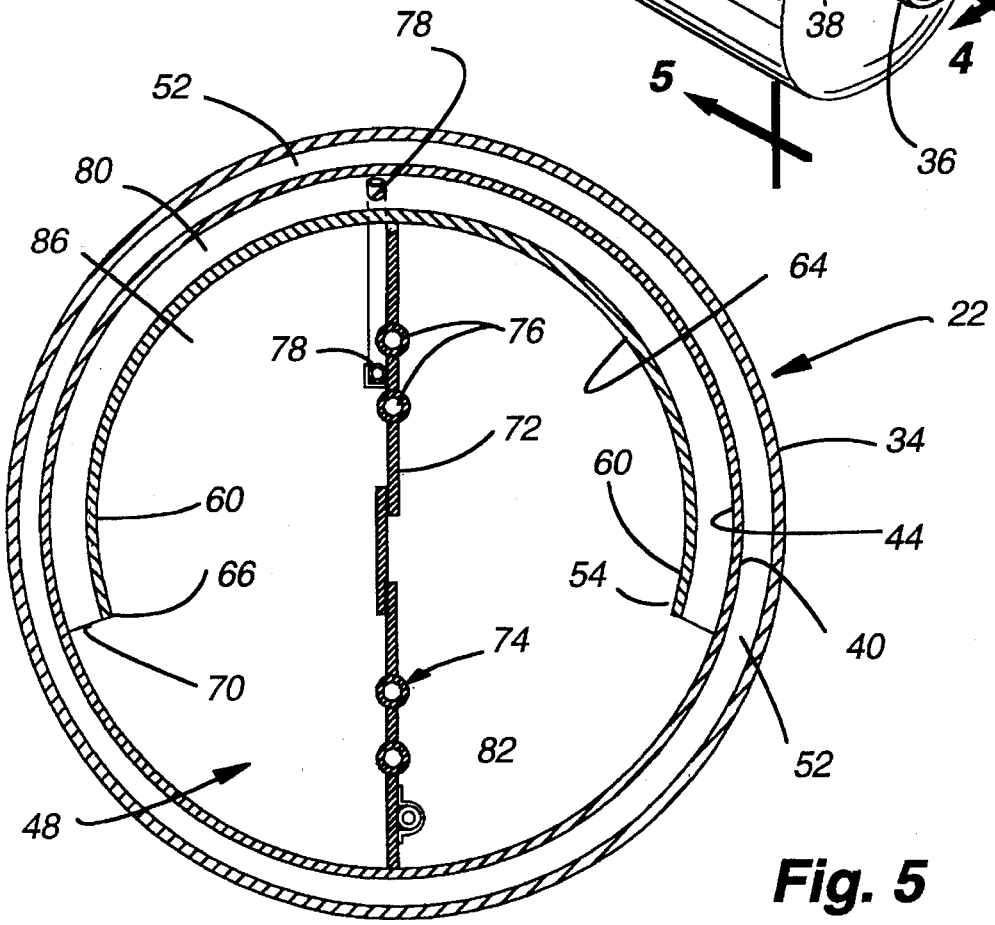
FIG. 5 is an enlarged section taken substantially along line 5—5 of FIG. 2.

Referring now to FIG. 5, the structure of the tank is shown in cross-section. The shroud 54, when attached to the interior side 44 of the inner container 40 divides the chamber 49 into two normally communicating portions, the portions normally communicating along the edges 66 of legs 60. One of these portions is the peripheral space 80 between the shroud 54 and the interior side 44 of the inner container 40 to which the shroud is adjacent. The volume of the peripheral space 80 is dependent upon both the width of the flanges 70 and the length of the shroud. The second portion is an interior space 86 beneath the shroud and extends beyond the ends of the shroud, as shown in FIG. 4.

In the preferred embodiment, the shroud 54 has the same general shape as the interior side 44 of the inner container 40, yet has a smaller diameter of curvature and length so as to fit within the inner container and provide a peripheral space 80 between the shroud and the interior side of the inner container. The disclosed cylindrical shape is preferred because it is easy to manufacture and permits simple volumetric calculations.

Referring now to FIGS. 6, 7, 8, and 9 the beneficial aspects of the shroud 54 as it acts in its capacity as an overfill protection device become apparent. The overfill protection system of the present invention insures that the tank 22, when filled, has a sufficient gas volume to allow the tank to sit after being filled for a predetermined hold time without the internal pressure reaching the relief pressure and venting gas to the atmosphere. For instance, if the initial pressure in the tank after being filled is 80 psi, and the relief pressure is 250 psi, there must be at least 18% gas volume, or no more than 82% liquid volume, to allow for a hold time of 7 or 8 days. If the gas volume is less than 18%, the internal pressure, given normal external conditions, might rise to the relief pressure before the hold time had expired.

When the tank 22 incorporating the overfill protection system of the present invention is filled with LNG, the LNG is pumped into the inner container 40 from a fill line (not shown) operably connected through the fill tubes 76. During the filling process, the LNG in the fill line has a pressure sufficient to allow the LNG to enter the tank. The fill tubes are perforated to cause the LNG to spray out of the fill tubes, with the liquid spray accumulating in the bottom of the inner container establishing a liquid level 88. As the spray accumulates, the fluid level of the LNG increases. As the LNG is sprayed out of the fill tubes, the spray condenses the natural gas through which it falls, thus reducing the pressure inside the tank. By reducing the pressure in this manner, the inner container 40 can be filled to approximately 95% of the volume of the chamber 49 with liquid without venting to the atmosphere.

When the liquid level 88 in the inner container 40 reaches the bottom of the shroud legs 60 (FIG. 6), the liquid effectively seals off or isolates the gas in the peripheral space 80 from the gas in the interior space 86 of the container 40. Prior to this point, the reduction in pressure in the container 40 caused by the LNG spray affected the entire chamber 49.

As the liquid gas continues to spray out of the fill tubes 76, the natural gas pressure in the chamber 49 remains essentially constant.

As the liquid level 88 increases in the interior space 86, it also increases in the peripheral space 80 but not at the same rate. The gas in the peripheral space is being compressed as the liquid level 88' in the peripheral space rises. The level of LNG in the interior space 86 increases faster than the level of LNG in the peripheral space 80, as shown in FIG. 7.

The encroachment of the liquid into the peripheral space 80 is directly related to the amount of liquid in the interior space 86. The liquid level 88 in the interior space translates into a force transmitted to the liquid level 88' in the peripheral space urging it to rise, acting to compress the gas trapped therein.

Figure 7:
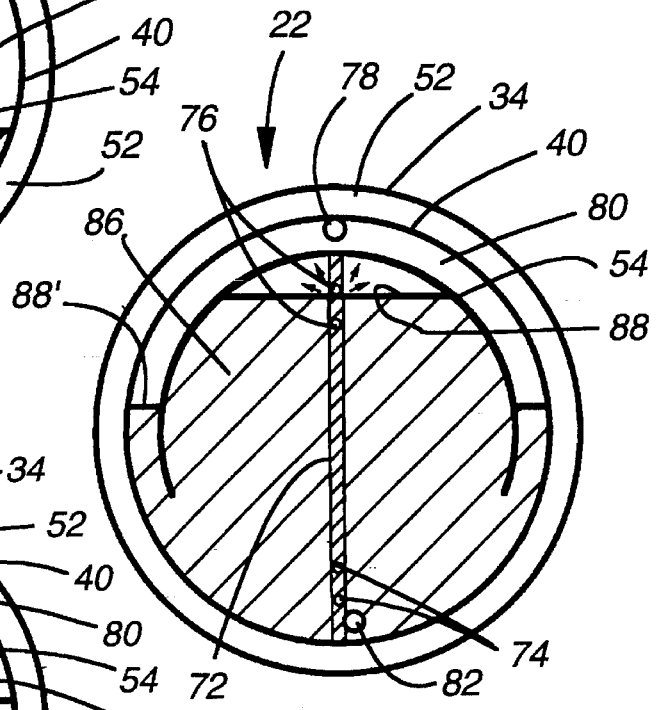
FIG. 7 is a schematic transverse section similar to FIG. 6 with the liquid level at an advanced state just prior to the time the input flow is terminated.

As the liquid level 88 in the interior space 86 reaches and overcomes the fill tubes 76, as shown in FIG. 7, the gas pressure starts to increase in the interior space 86 due to fluid encroachment which compresses the gas therein. The effect causes the tank to resist receiving more fluid through the fill tubes 76, thus reducing the fill rate into the fuel tank 22. Once the input fill rate is reduced by this process to a pre-determined level, the input flow is terminated by a flow rate sensitive valve system (not shown) external to the tank. The valve system is operable to monitor the rate of flow of LNG into the tank through the fill tubes, and terminates the input of LNG upon a predetermined reduced flow rate.

Figure 10:
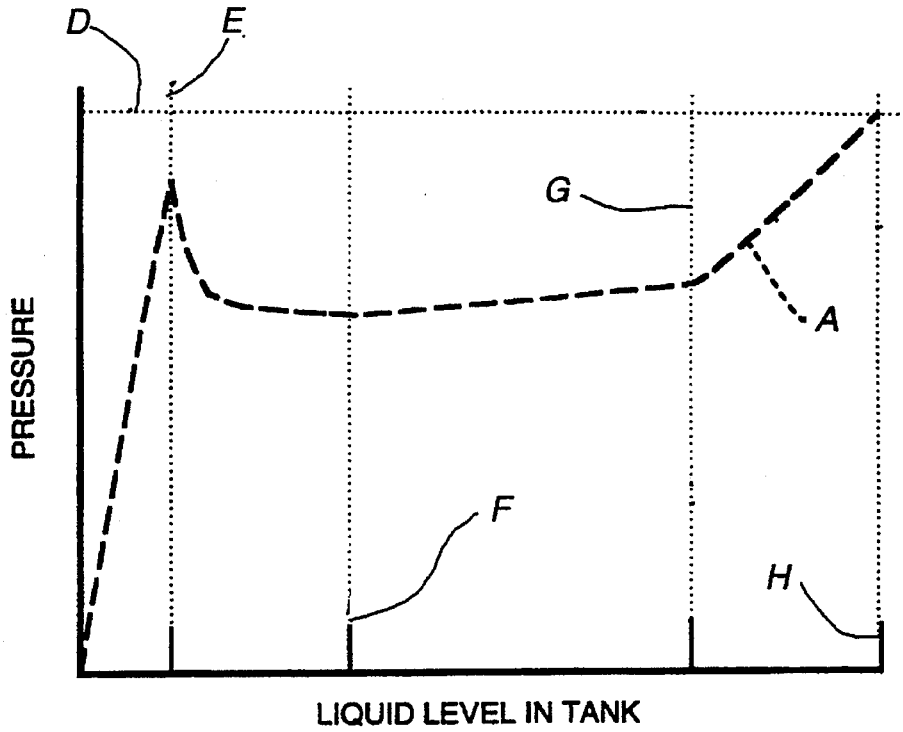
FIG. 10 is a graphical representation of the pressure in the chamber versus the liquid level in the tank.

FIG. 10 is a graphical representation of the pressure in the chamber 49 as compared to the liquid level in the tank during filling. The horizontal axis represents the liquid level in the tank. The vertical axis represents the pressure in the tank.

Line A represents the pressure in the chamber 49 during the filling process. Reference letter D indicates the pump discharge pressure level. Reference letter E indicates the liquid level at which substantially all heat is removed from the fill line. Reference letter F indicates the liquid level at which the shroud is contacted. Reference letter G indicates the liquid level at which the fill tube aperture is reached. Reference letter H indicates the point at which the full liquid volume is reached. The fill tubes 76 are connected to a fill line (not shown), which is at ambient temperature. The LNG used to fill the tank flows through the fill line to the fill tubes, and the LNG absorbs any heat in the fill lines until the fill lines are at the same temperature as the fill tubes. The pressure in the chamber increases rapidly until all of the heat has been removed from the fill line. This transition is shown by the intersection of Line A and the liquid level indicated by reference letter E. Line A then shows the pressure in the chamber decreasing as the liquid level increases. This is due to the condensation effect of the spray. The chamber pressure then gradually levels off after the spray condensation effect recedes.

After the peripheral space 80 and interior space 86 become isolated by the liquid level 88, as indicated by the intersection of Line A with the liquid level indicated by reference letter F, the chamber 49 pressure begins to increase slightly. After the liquid level 88 reaches the fill tubes 76, as indicated by the intersection of Line A and the liquid level indicated by reference letter G, the chamber pressure increases to the pump discharge pressure. This pressure corresponds to a predetermined fill rate, which has been calculated to indicate that the tank is at the appropriate liquid volume and gas volume necessary for the required holding time.

Figure 8:
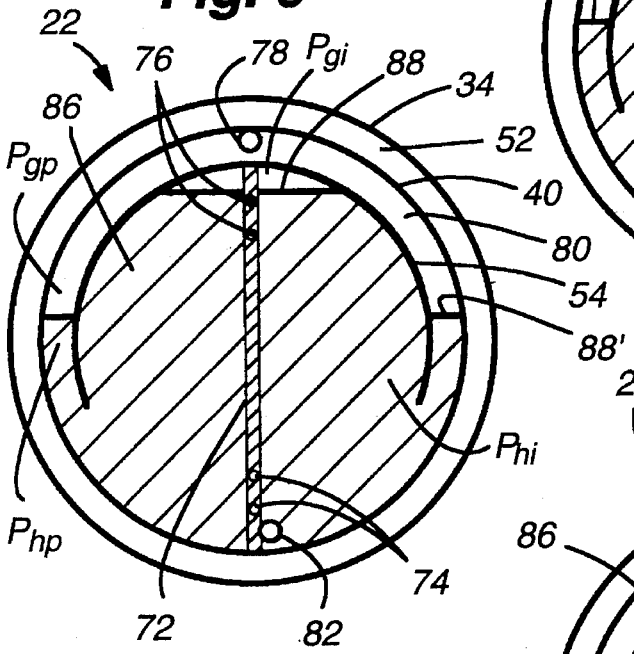
FIG. 8 is a schematic transverse section similar to FIG. 7 showing differential liquid levels after the termination of the input flow.

After the input flow has been terminated, as shown in FIG. 8, there is a fixed volume of gas trapped in the peripheral space 80, while the interior space 86 is substantially filled with LNG. The shroud was designed to cause a predetermined gas volume to reside in the peripheral space after the input flow has been terminated. This predetermined gas volume provides for the necessary holding time for the tank.

The liquid level 88 is higher than the liquid level 88'. As FIG. 8 depicts, as measured from the bottom of the tank, the pressure of the gas in the peripheral volume 80, $P_{gp}$, plus the head pressure of the liquid encroaching on the peripheral volume, $P_{hp}$, is equivalent to the pressure of the gas in the interior volume 86, $P_{gi}$, plus the head pressure of the liquid in the interior volume, $P_{hi}$. In sum, $P_{gp}+P_{hp}=P_{gi}+P_{hi}$. Accordingly, the different liquid levels, 88 and 88', result.

Thus, the benefits of the present invention have been clearly established, including that no internal tank monitors are needed to insure the appropriate gas volume remains after filling is complete. Only the fill rate of the input gas needs to be monitored.

By knowing the input conditions of the LNG and conditions within the tank 22 to be filled, the shroud 54 is designed to act as an overfill protection device which will provide the correct gas volume, in the peripheral space 80, necessary to allow an adequate holding time after the filling has been completed. Knowing the conditions of the tank 22 and of the fluid being used to fill the tank, the amount of fluid encroachment into the peripheral space 80 can be calculated to insure that the end peripheral space after filling contains a sufficient amount of gas to provide an adequate hold time, as stated above.

The location of the fill tubes 76 with respect to the shroud 54 affects the pressure characteristics in the inner container 40 near the end of the fill procedure. If the fill tubes 76 are located below the shroud as in FIGS. 5, 6, and 7, when the liquid level 88 overcomes the fill tube, there is still a vapor space, or gas volume, above the liquid level 88 of the liquid under the shroud which allows for the liquid level to continue to increase. As the level of liquid in the interior space 86 encroaches on the trapped vapor space between the liquid level 88 and the shroud, the pressure of the vapor space increases in a predictable and non-abrupt manner. The gradual and predictable increase in the pressure causes a corresponding gradual decrease in the fill rate, thus the target flow rate for terminating the fill is easier to detect.

The benefit of having the fill tubes 76 spaced a distance below the shroud 54 is that since the fill rate changes less drastically once the fluid level rises up to and above the fill tube, different levels of fill rate changes can be easily monitored and used to trigger when to terminate the fill process.

Figure 9:
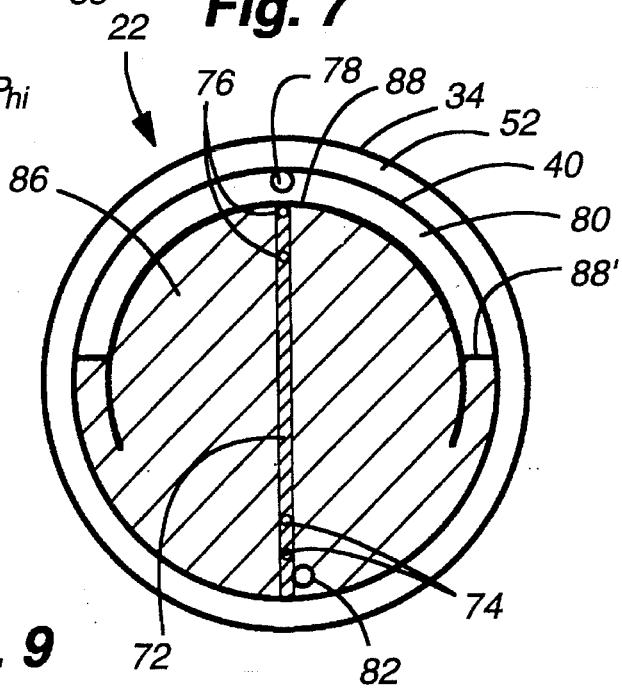
FIG. 9 is a schematic transverse section similar to FIG. 8 illustrating the differential liquid levels in an alternative embodiment.

If the fill tube is located substantially adjacent to and below the shroud, as shown as an alternative embodiment in FIG. 9, when the liquid level 88 overcomes the apertures in the fill tube 76 there is virtually no vapor space above the liquid level for the liquid to compress. Thus, at this point, the pressure within the inner container 40 rises much more abruptly, thus causing the fill rate to decrease much more drastically. While this maximizes the amount of liquid in the tank, the change in pressure is quite abrupt and more difficult to control and monitor. The major benefit of having the fill tube located just underneath the shroud is that the liquid volume of the tank is maximized.

Figure 11:
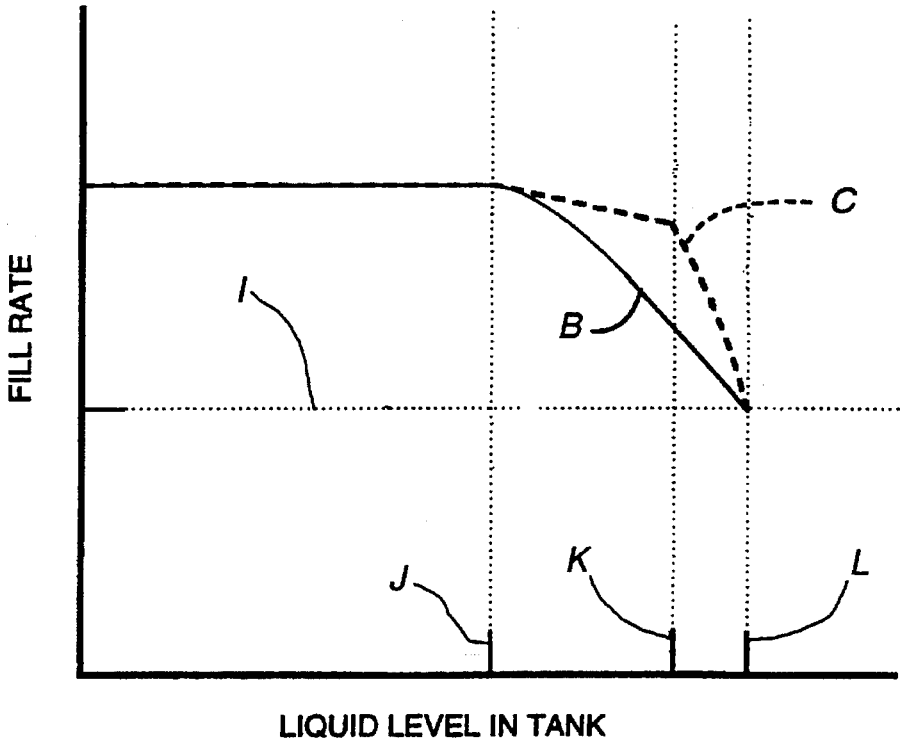
FIG. 11 is a graphical representation of the change in fill rate versus the liquid level in the tank.

FIG. 11 is a graphical representation of the fill rate as it varies according to the liquid level 88 in the tank for two different fill tube 76 positions. The horizontal axis represents the LNG liquid level in the tank. The vertical axis represents the fill rate of the LNG into the tank. Line B represents the changes in the fill rate when the fill tubes 76 are in the lower position spaced away from the shroud 54. Line C represents the changes in the fill rate when the fill tubes 76 are in the upper position, essentially being adjacent to and below the shroud. Reference letter I indicates the fill rate shut-off value. Reference letter J indicates the transition in fill rate when the liquid level covers the fill tube when in the lower position. Reference letter K indicates the transition in fill rate when the liquid level covers the fill tube when in the upper position. Reference letter L indicates the fill rate at which the desired liquid level is in the tank.

The fill rate is generally the same for either configuration until the liquid level 88 overcomes the fill tubes 76. At the lower fill tube position the fill tubes are overcome at a lower liquid level than the fill tubes at the upper position. As Line B indicates, the decrease in fill rate to the fill rate indicated by reference letter I, or the shut-off fill rate level, is relatively gradual, as described previously. Line C indicates that the decrease in fill rate to the shut off level after the liquid level has overcome the fill tubes in the upper position is much more abrupt and severe.

The length of the shroud legs 60 can vary to make the shroud more than or less than semi-cylindrical. The length of the legs depends on two factors. The first is the volume of gas necessary to obtain a sufficient hold time after the tank is filled. This factor is considered by the user when designing the tank 22 for certain uses given desired LNG properties. The second factor is related to the position of the tank while being filled and also the varying positions it is subjected to during use. If the legs 60 are made to the exact length necessary to obtain the desired gas volume after fill, that length would work only if the tank were not tilted in any direction while being filled. If, however, the tank were tilted slightly in any direction, the end gas volume in the peripheral space 80 would be reduced. By lengthening the shroud legs, the resulting peripheral gas volume becomes less sensitive to tank positioning because the liquid level would contact the legs at a lower liquid level, thus minimizing the impact due to tilting on the peripheral space. Also, during use, the tank can be tilted more without violating the isolation between the peripheral and interior spaces.

Although the present invention has been described with a certain degree of particularity, it is understood that the present disclosure has been made by way of example, and changes in detail or structure may be made without departing from the spirit of the invention, as defined in the appended claims.

The invention claimed is:

1. A liquified gas tank overfill protection system for a tank having a wall defining a hermetically sealed chamber, said wall having an interior side and a portal for introducing a liquified gas into the chamber to accumulate in said tank, the introduction of the liquified gas resulting in a rising liquid level within said chamber, said overfill protection system comprising a shroud mounted in said chamber in spaced relationship to said interior side so as to divide said chamber into a plurality of spatially normally communicating portions, said portions being selectively isolated by liquid in said chamber upon the liquid level reaching a predetermined level.

2. An overfill protection system as defined in claim 1, wherein said shroud has a generally elongated concave downward shape with opposite ends and downwardly depending legs defining longitudinal edges extending the length of said shroud, said shroud being hermetically sealed to said interior side along said opposite ends, and said edges being spaced from said interior side whereby said shroud normally divides said chamber into two portions communicating along said edges.

3. An overfill protection system as defined in claim 2, wherein the tank has a top and a bottom, and wherein said shroud is positioned adjacent to the top of said tank and said legs are of equal length.

4. An overfill protection system as defined in claim 2, wherein said shroud is positioned in a coaxial relationship within said tank.

5. An overfill protection system as defined in claim 2, wherein:

a. each of said opposing ends define a peripheral edge; and further comprising:

b. an elongated flange, said flange attached to each of said peripheral edges and extending outwardly therefrom, said flange having an outer edge; and c. said outer edge of said flange being hermetically attached to said interior side.

6. An overfill protection system as defined in claim 5, wherein said flange extends radially therefrom.

7. A liquified gas tank overfill protection system, wherein the tank has a wall having a generally elongated cylindrical shape defining a periphery, said tank having enclosed opposing ends defining a hermetically sealed chamber within said tank, and the wall having an interior side, said overfill protection system comprising:

a. a shroud having an elongated partially cylindrical body defining downwardly depending legs and having opposing ends, each of said legs terminating in a longitudinal edge, said opposing ends each defining a peripheral edge;

b. an elongated flange hermetically attached along each of said peripheral edges and extending substantially radially from said body, each of said flanges having an outer edge; and c. said outer edges of each of said flanges being hermetically attached to the interior side of said wall along the periphery, said shroud dividing the chamber into a peripheral space between the shroud and the interior wall, and a remaining interior space normally communicating with said peripheral space along said legs.

8. A method for filling a tank with liquified gas to a level where there remains a sufficient minimum amount of gas vapor volume, said tank having gas vapor present in the tank during filling, said method comprising:

a. providing a tank having a wall defining a hermetically sealed chamber, said wall having an interior side;

b. introducing a liquified gas into the chamber to accumulate in said tank, the deposition of the liquified gas resulting in a rising liquid level;

c. providing an overfill protection system comprising:

d. a shroud defining a peripheral edge hermetically attached along portions of said peripheral edge to and spaced away from a portion of the interior side, said shroud dividing the chamber into a plurality of normally communicating portions, wherein the liquified gas is introduced into all but at least one of said plurality of portions;

e. designing said shroud to cause the isolation of the gas vapor in said portions from one another upon the liquid level reaching a predetermined level; and f. terminating said spray when the minimum gas volume is obtained.

9. A liquified gas tank overfill protection system for a tank having a wall defining a hermetically sealed chamber, said wall having an interior side and a portal for introducing a liquified gas into the chamber to accumulate in said tank, the tank having gas vapor inside the chamber during filling, the introduction of the liquified gas resulting in a rising liquid level within said chamber, said overfill protection system comprising a shroud mounted in said chamber in spaced relationship to said interior side so as to divide said chamber into a plurality of spatially normally communicating portions, said gas vapor in said portions being isolated by liquid in said chamber upon the liquid level reaching a predetermined level.

10. An overfill protection system as defined in claim 9, wherein said shroud has a generally elongated concave downward shape with opposite ends and downwardly depending legs defining longitudinal edges extending the length of said shroud, said shroud being hermetically sealed to said interior side along said opposite ends, and said edges being spaced from said interior side whereby said shroud divides said chamber into two portions normally communicating along said edges.

11. An overfill protection system as defined in claim 10, wherein the tank is surrounded by an environment, the tank has a top and a bottom, and the tank has an internal pressure, and wherein said shroud is positioned adjacent to the top of said tank and said legs are of equal length; and further comprising an elongated vent tube extending from said gas vapor in said portion above said shroud to the environment allowing gaseous communication between said portion and the environment when the pressure reaches a predetermined level.

12. An overfill protection system as defined in claim 10, wherein:

a. each of said opposing ends define a peripheral edge; and further comprising:

b. an elongated flange, said flange attached to each of said peripheral edges and extending outwardly therefrom, said flange having an outer edge; and c. said outer edge of said flange being hermetically attached to said interior side.

13. An overfill protection system as defined in claim 12, wherein said flange extends radially therefrom.

* * * * *